United States Patent [19]

Wiedemann

[11] 4,224,395

[45] Sep. 23, 1980

[54] ELECTROPHOTOGRAPHIC RECORDING MATERIAL WITH CELLULOSE ACYL ESTER BINDER

[75] Inventor: Wolfgang Wiedemann, Geisenheim-Johannisberg, Fed. Rep. of Germany

[73] Assignee: Hoechst Aktiengesellschaft, Fed. Rep. of Germany

[21] Appl. No.: 928,375

[22] Filed: Jul. 27, 1978

[30] Foreign Application Priority Data

Jul. 29, 1977 [DE] Fed. Rep. of Germany ..... 2734289

[51] Int. Cl.[2] ..... G03G 5/06; G03G 5/087; G03G 5/14

[52] U.S. Cl. ..... 430/59; 430/56; 430/58

[58] Field of Search ..... 96/1.5 R, 1.6, 1.8, 96/113; 430/56, 58, 59

[56] References Cited

U.S. PATENT DOCUMENTS

| | | | |
|---|---|---|---|
| 2,327,808 | 8/1943 | Lowe et al. | 96/113 |
| 2,748,022 | 5/1956 | Hilborn | 96/113 X |
| 3,155,503 | 11/1964 | Cassiers et al. | 96/1.5 R |
| 3,331,687 | 7/1967 | Kosche | 96/1.5 R |
| 4,072,520 | 2/1978 | Rochlitz et al. | 96/1.5 R |

FOREIGN PATENT DOCUMENTS 1246407 8/1967 Fed. Rep. of Germany .

*Primary Examiner*—Roland E. Martin, Jr.
*Attorney, Agent, or Firm*—James E. Bryan

[57] ABSTRACT

This invention relates to an improvement in an electrophotographic recording material comprising an electrically conductive support, optionally an insulating intermediate layer, and a photoconductive layer composed of at least one layer comprising charge carrier-producing and charge transporting compounds, a binder, and conventional additives, the improvement that the recording material comprises a 75 to 250 μm thick support and, in the form of a photoconductor web, is sufficiently flexible that it is not prone to the formation of hairline cracks when repeatedly conducted over rollers of at least 18 mm diameter, said binder being a cellulose acyl ester with an acetyl content of not more than 30 percent and a viscosity of more than 15 poises, measured by the ASTM methods D 817-65, Formula A, and D 1343-56.

14 Claims, 4 Drawing Figures

ELECTROPHOTOGRAPHIC RECORDING MATERIAL WITH CELLULOSE ACYL ESTER BINDER

Figure 1:
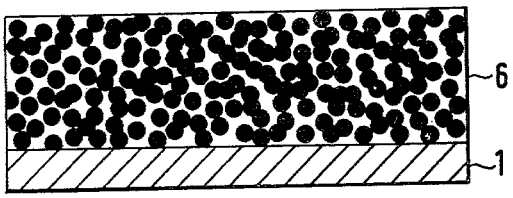

The present invention relates to an electrophotographic recording material comprising an electrically conductive support, optionally an insulating intermediate layer, and a photoconductive layer composed of at least one layer comprising charge carrier-producing and charge transporting compounds, binders, and conventional additives. In particular, the invention relates to a recording material whose photoconductive layer is composed of a charge carrier producing layer and a charge transport layer.

Photoconductive layers are known, for example, from German Offenlegungsschriften Nos. 2,108,935, 2,108,938, 2,108,944, 2,108,958, 2,108,968, 2,108,984, and 2,108,992. While the electrophotographic properties of such layers are relatively good, the mechanical properties thereof are not satisfactory, because the normally used and mainly described polyvinyl carbazole, which forms the charge transport layer, is not very flexible and its compatibility and miscibility with binders and resins is poor due to its high molecular weight and chemical nature. Moreover, the adhesion of such layers to the electrically conductive support is not sufficient for practical purposes. Therefore, the use of such materials so far has been limited to photoconductive systems in which they are exposed to less severe stress.

German Offenlegungsschriften Nos. 2,220,408, 2,314,051, and 2,353,639, disclose flexible photoconductive layers of good adhesion, but even these do not meet the very high demands made of heavy duty self-supporting recording materials, e.g. photoconductor webs.

Thus, when the recording material is repeatedly passed over rollers of small diameter, fine hairline cracks appear in the photoconductor surface. The high bending stress exerted upon the photoconductor layer, which, moreover, may be on a relatively thick support, causes a slow mechanical destruction of the photoconductive layer.

It is the object of the present invention to provide an electrophotographic recording material which is highly photosensitive and whose flexibility is so modified and improved that it can be safely used even on relatively thick supports and under severe mechanical stress, for example as an endless photoconductor web, and may be passed, for example, over rollers of small diameter.

For solving this problem, use is made of an electrophotographic recording material which comprises an electrically conductive support, optionally an insulating intermediate layer, and a photoconductive layer composed of at least one layer comprising charge carrier-producing and charge transporting compounds, binders, and conventional additives. The recording material comprises a 75 to 250 μm thick support and, in the form of a photoconductor web, is sufficiently flexible that it is not prone to the formation of hairline cracks if it is repeatedly conducted over rollers of at least 18 mm diameter. The binder used is a cellulose acyl ester with an acetyl content of not more than 30 percent and a viscosity of more than 15 poises, measured by the ASTM methods D 817-65, Formula A, and D 1353-56. Preferably, the cellulose acyl ester has an acetyl content of not more than 15 percent and a viscosity of more than 15, especially more than 50 poises. The acyl groups preferably have two to four carbon atoms. In order to determine the viscosity in accordance with ASTM method D 817-65, Formula A, and method D 1343-56, 20 parts by weight of the cellulose acyl ester are dissolved in a mixture of 8 parts by weight of ethanol (95 percent by volume) and 72 parts by weight of acetone, and then the falling-ball method is employed at 25° C.

By the present invention, an electrophotographic recording material is provided which, as compared with materials containing hitherto known conventional binders, possesses a high flexibility, in combination with an equally good photosensitivity and low residual charge.

Due to these properties, the material according to the invention may be used for photoconductor webs which are exposed to severe mechanical stress, for example those running in copying cycles at relatively high speeds. A recording material comprising, as the binder, a cellulose acetobutyrate with an acetyl content of not more than 15 percent and a viscosity in the range of 60 to 110 poises, measured according to the ASTM methods D 817-65, Formula A, and D 1343-56, was found suitable for particularly high mechanical stress. Repeated passage over rollers, normally 5000 times, may be effected in a bending stress test, for example.

Figure 2:
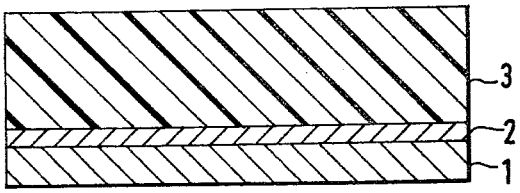
Figure 3:
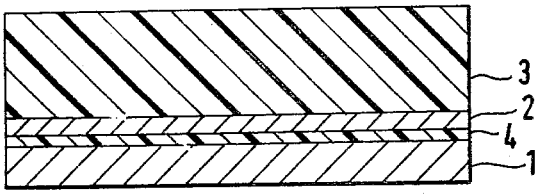
Figure 4:
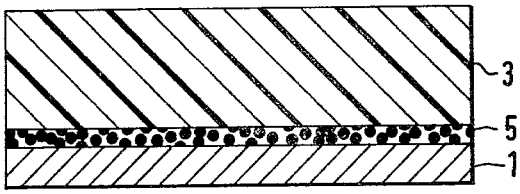

The invention will be further illustrated by reference to the accompanying drawings in which:

FIG. 1 shows an embodiment of the invention including a single photoconductive layer, and FIGS. 2 to 4 show embodiments of the invention in which the material includes separate charge-carrier producing and charge transporting layers.

An embodiment comprising a single photoconductive layer (FIG. 1) has the advantage of being more easily prepared. On the other hand, a material comprising separate charge carrierproducing and charge transporting layers (FIGS. 2 to 4) provides the advantage that the particles are present in a compact arrangement and that an optimal rate of charge carrier production is achieved. Less thermally stable dyestuffs which cannot be applied to the electrically conductive support by vacuum deposition may be used for the embodiments of the invention shown in FIGS. 1 and 4.

The use of cellulose acyl esters in photoconductor compositions already has been disclosed for the development of photoconductive layers. In the enumeration of suitable binders, for example, cellulose esters and cellulose ethers are frequently mentioned (see, e.g., German Pat. No. 1,246,407). The highly exceptional suitability with regard to flexibility and photosensitivity, which was found to be possessed by the cellulose acyl esters, was surprising, however, and was not to be anticipated.

It is known, from German Offenlegungsschriften Nos. 2,452,622, and 2,452,623, to use cellulose esters, in addition to other binders, in protective coatings applied to photoconductor layers, such as those disclosed, e.g., in German Auslegeschrift No. 1,572,347. These protective layers may further contain substances which increase the conductivity of the layer within a resistance range between $10^7$ and $10^9$ ohm, and also photoconductive organic substances. In view of the relatively high electrical conductivity and a mixing ratio of up to 30 percent by weight of photoconductor which are mentioned, however, such compositions are not suitable for the recording material according to the invention.

The structure of the recording material according to the invention is diagrammatically shown in four embodiments in the accompanying FIGS. 1 to 4. Numeral 1 in each case indicates the electrically conductive support, numeral 2 indicates the charge carrier-producing layer, numeral 3 is the charge transport layer, and numeral 4 indicates the insulating intermediate layer. Numeral 5 indicates a charge carrier-producing layer which is in dispersion. Numeral 6 indicates a photoconductive layer which comprises a photoconductor as the charge transporting compound, a dyestuff as the charge carrier-producing compound, a binder and possibly other additives.

Aluminum foil, or a transparent polyester film with a vapor-deposited aluminum layer thereon, or a polyester film with an aluminum layer laminated thereto, with a thickness of up to 300 μm, are peferred as electrically conductive supports, but other electrically conductive supporting materials also may be used. The support may be a flexible endless web and may be, e.g., of nickel or steel. According to the invention, a support is used which, in the form of a web, is substantially rigid in the transverse direction and flexible and dimensionally stable in the longitudinal direction. In addition to metal bands, which fully meet these requirements at thicknesses as low as 100 to 120 μm, aluminum-vaporized polyester films of appropriate thickness, mainly in the range from 75 to 250 μm, are preferred. It was found that the greater thickness of these supports is required to provide the necessary rigidity. As a consequence, the applied coating must have a correspondingly higher flexibility. If webs are used as supports, the loops required for use in high speed copying apparatuses may be formed by welding.

The insulating intermediate layer 4 may be of organic material or, if desired, of an aluminum oxide layer produced by a thermal, anodic, or chemical process. In addition to its function as an adhesion-promoting layer, the intermediate layer has the purpose of reducing by its presence the charge carrier injection from the support into the photoconductive layer in the dark. On the other hand, it does not interfere with the charge flow during the exposure process. Natural or synthetic resin binders may be used for the intermediate layer, e.g. polyamide resins, polyvinyl phosphonic acid, polyurethanes, or polyester resins. Their thickness may be up to 5 μm, while the thickness of aluminum oxide layers is generally in the range from $10^{-2}$–1 μm.

As the charge carrier-producing compounds, those inorganic or organic substances are used which have already been used for this purpose. Examples of such compounds are dyestuffs and amorphous selenium. The spectral light-sensitivity of the photoconductive layer is determined, in particular, by the dyestuffs used or by the inorganic substances present, e.g. tellurium.

The application of a homogeneous, tightly packed dyestuff layer as the charge carrier-producing layer is known and is achieved by a vapor-deposition of the dyestuff on the support under reduced pressure. Depending on the adjustment of the vacuum ($10^{-3}$ to $10^{-5}$ Torr at a heating temperature of between 250° and 400° C.), the dyestuffs can be vapor-deposited under relatively favorable conditions without decomposition. The temperature of the support is below 50° C.

The layers thus produced are distinguished by tightly packed dyestuff molecules. This has the advantage that the high extinction of the dyestuffs enables a high concentration of excited dyestuff molecules.

Depending upon the purpose of the material, a charge carrier-producing layer of uniform thickness also may be produced by other coating techniques, for example by mechanical rubbing of the very finely pulverized material into the electrically conductive support, by chemical deposition of, e.g., a leuco base which is then to be oxidized, by electrolytic or electrochemical processes, by gunspray methods, or by application from a solution, followed by drying.

As a combination of the dyestuff with materials for the insulating intermediate layer 4 (FIG. 3), or instead of an intermediate layer, it is also possible to produce 0.01 to 3 μm thick homogeneous dyestuff layers of good covering capacity by dispersing the dyestuff in the binder according to the invention and coating the electrically conductive support with the dispersion (layer 5 in FIG. 4). It is particularly advantageous to use high viscosity cellulose acyl esters for this purpose, because a very good distribution of the pigments during the coating process (small particle size) is achieved by grinding. The ratio between the charge carrierproducing substance and the binder may vary within wide limits. Coatings with a dyestuff content of more than 50 percent by weight and correspondingly high optical density are preferred, however. In this manner, dyestuffs may be used which are less stable thermally, e.g. azo dyestuffs or bisazo dyestuffs. At the same time, an adhesive effect is achieved by the presence of the binder.

Dyestuffs of very different types may be used as charge carrier producing substances. The following are suitable, for example:

Perylene-3,4,9,10-tetracarboxylic acid anhydride and perylene-3,4,9,10-tetracarboxylic acid imide derivatives according to German Offenlegungsschrift No. 2,237,539; polynuclear quinones according to German Offenlegungsschrift No. 2,237,678;

cis- and trans-perinones according to German Offenlegungsschrift No. 2,239,923;

thioindigo dyestuffs according to German Offenlegungsschrift No. 2,237,680;

quinacridones according to German Offenlegungsschrift No. 2,237,679;

condensation products of benzo-4,10-thioxanthene-3,1′-dicarboxylic acid anhydride and amines according to German Offenlegungsschrift No. 2,355,075, phthalocyanine derivatives according to German Offenlegungsschrift No. 2,239,924, and dyestuffs which are produced from perylene-3,4,9,10-tetracarboxylic acid anhydride and o-phenylene diamine or 1,8-diaminonaphthalene by condensation according to the method disclosed in Bull. Chem. Soc. Japan 25, 411–413 (1952).

As already mentioned, thin charge carrier-producing layers composed of inorganic substances and produced by vapor deposition of selenium, doped selenium, cadmium sulfide, and the like, are also suitable.

Charge transporting compounds are used as photoconductors in the photoconductive layer, especially in the charge transport layer. Suitable compounds are, above all, organic compounds having an extended $\pi$-electron system. They include monomeric and polymeric aromatic carbocyclic and heterocyclic compounds.

Among the monomeric compounds, those are preferred which contain at least one dialkyl amino group. Heterocyclic compounds, such as oxadiazole derivatives according to German Auslegeschrift No. 1,058,836, in particular 2,5-bis-(4′-diethylaminophenyl)-oxadiazole-1,3,4, have proved to be particularly suitable. Further monomeric compounds which may be used are, for example, triphenylamine derivatives, relatively highly condensed aromatic carbocyclic compounds, such as pyrene, benzo-condensed heterocyclic compounds, furthermore pyrazoline or imidazole derivatives according to German Pat. Nos. 1,060,714, and 1,106,599. Further suitable compounds are the triazole, thiadiazole and oxazole derivatives disclosed in German Pat. Nos. 1,060,260, 1,299,296, and 1,120,875.

Among the polymeric compounds, relatively highly condensed aromatic compounds, such as the formaldehyde condensation products of various aromatic compounds, e.g. formaldehyde/3-bromopyrene condensates according to German Offenlegungsschrift No. 2,137,288, have proved to be particularly advantageous.

In the absence of the charge carrier-producing layer, the charge transport layer displays practically no photosensitivity in the visible range of the spectrum from about 420 to 750 nm. Preferably, it is a mixture of an electron donor compound, as the photoconductor, and a resin binder, if the resulting recording material is to be negatively charged. The layer preferably is transparent.

Besides the charge carrier-producing and the charge transporting substances contained in the layer, the binder present influences the mechanical behavior of the material, such as abrasion, flexibility, film formation, and the like, and also the electrophotographic properties, such as photosensitivity, residual charge, etc. According to German Offenlegungsschrift No. 2,353,639, film-forming compounds, such as polyester resins, polyvinyl chloride/polyvinyl acetate copolymers, styrene/maleic acid anhydride copolymers, silicone resins, reactive resins, DD-lacquers, polycarbonates and acrylates and methacrylates hitherto have been used as binders.

Surprisingly, it was found that the use of cellulose acyl esters instead of the hitherto used binders leads to an essential increase and improvement of the elasticity of the photoconductor layer, in combination with an equally good or even better photosensitivity.

Copying machines in which the material of the web is under high mechanical stress during operation, require a higher elasticity of the photoconductor layer, which may be achieved by the use of highly viscous cellulose acyl esters.

Preferably, such cellulose acyl esters are used as binders which are commercially available in different degrees of viscosity and with different substituents. Cellulose acyl esters with an acetyl content of not more than 15 percent and a viscosity above about 50 poises are particularly suitable. With regard to the requirement for higher flexibility, cellulose acyl esters with higher viscosities, up to 200 poises, also may be used according to the invention.

The Ubbelohde method also is used for determining the viscosity. According to the Ubbelohde viscosimeter method, solutions containing 5 parts by weight of the cellulose acyl ester and 95 parts by weight of tetrahydrofuran, used with correspondingly applied capillaries in the range from I to III at 25° C. (according to DIN 51 562) should have a viscosity of at least 20 cSt.

Electrophotographic recording materials containing these cellulose products as binders yield films of high elasticity.

The cellulose acyl esters differ from each other not only by their degree of viscosity, but also by their acyl residues. It was found that with an increasing proportion of butyryl groups, instead of acetyl groups, the photoconductive system becomes more light-sensitive. Therefore, it has been found to be particularly advantageous according to the present invention, to use high viscosity cellulose acetobutyrates with an acetyl content of not more than 15 percent and a butyryl content of at least 15 percent, for example. Cellulose propionates with a high propionyl content or cellulose acetobutyrates with a high butyryl content also may be used, and mixtures of different cellulose acyl esters are also suitable.

The mixing ratio between the charge transporting compound and the binder may vary. However, the requirement for maximum photosensitivity, i.e. as high as possible a content of charge transporting compound, on the one hand, and the necessity to prevent the compound from crystallizing out and to increase the flexibility of the material, which means as high as possible a proportion of the cellulose acyl ester, on the other hand, restrict the variations within relatively narrow limits.

Altogether, the preferred ratio of cellulose acyl ester to charge transporting compound is in the range from 20 to 60 parts by weight to 80 to 40 parts by weight. Too high a proportion of monomers has an adverse effect on flexibility, so that for the particularly advantageous flexible embodiments of the invention the proportion of cellulose acyl ester to charge transporting compound is about 60:40 to 40:60, preferably about 50:50 parts by weight.

If polymeric charge transporting compounds are used, the cellulose acyl ester proportion is below 50 percent by weight.

If the charge transport layers contain monomers, such as 2,5-bis-(4'-diethylaminophenyl)-oxadiazole-1,3,4, the layers are amorphous, as shown by Röntgen-Goniometer measurements.

The thickness of the photoconductive layer is in a range corresponding to a layer weight between about 5 and 50 g/m$^2$. If the photoconductive layer is in the form of a charge carrier producing layer and a charge transporting layer, layer thicknesses in the range from 0.005 to 2 μm, preferably from 0.005 to 1 μm, and in the range from 2 to 20 μm, preferably from 3 to 10 μm, are appropriate. If the charge producing layer is in the form of a dispersion, layer thicknesses ranging from 0.1 to 1 μm are suitable.

In special cases, these limits may be extended into the higher or lower region, if the mechanical requirements and the electrophotographic parameters, such as the charging and developing station of a copying apparatus, do not prohibit such extension.

Conventional additives in connection with this invention are flow agents, such as silicone oils, wetting agents, especially non-ionogenic substances, or plasticizers of different compositions, for example those based on chlorinated hydrocarbons or on phthalic acid esters. If desired, sensitizers and/or acceptors may be added to the charge transport layer, but only to such an extent that the optical transparency of the charge transport layer is not substantially impaired by such additives.

The invention will be further illustrated by reference to the following examples:

EXAMPLE 1

At a pressure between $10^{-4}$ and $10^{-5}$ Torr and a temperature of approximately 280° C., the pigment dyestuff N,N'-dimethylperylene-3,4,9,10-tetracarboxylic acid diimide is vapor-deposited for 2 minutes, in a vacuum deposition apparatus, onto an aluminum vaporized polyester film of 75 μm thickness. The distance between the vaporizer source and the substrate is about 20 cm. The vapor-deposited homogeneous dyestuff has a thickness corresponding to a layer weight of 100 to 200 mg/m$^2$. The electrically conductive support is completely covered by the dyestuff layer.

For each sample, a tetrahydrofuran (THF) solution containing equal parts by weight of 2,5-bis-(4'-diethylaminophenyl)-oxadiazole-1,3,4,(melting point 149°–150° C.) and one of the following cellulose derivatives is whirler-coated onto this layer:

(a) ethyl cellulose with an ethoxyl content of 47.5–49 percent, (b) cellulose acetate with an acetyl content of 38.4 percent, and (c) cellulose propionate with a propionyl content of 44.7 percent.

After drying for about 5 minutes in a circulating air drier at 110° C., the applied layers have a thickness in each case of 9 to 10 μm.

The photosensitivity of the photoconductive double layers thus produced is measured as follows:

For determining the light discharge curve, each sample to be measured is moved on a rotating plate first through a charging station and then to an exposure station where it is continuously exposed to the light of a xenon lamp of type XBO 150, marketed by Messrs. Osram. A heat-absorbing glass of type KG 3, marketed by Messrs. Schott & Gen., Mainz, Germany, and a neutral filter with a transparency of 15 percent are attached to the lamp. The light intensity in the measuring plane is in the range from 70 to 170 μW/cm$^2$; it is measured immediately after the light decay curve has been measured by means of an Opto-Meter model -80X (United Detector Technology, Inc.). The voltage of the charge ($U_o$) and the photo-induced light decay curve are oscillographically recorded through a transparent probe, using an electrometer of type 610 CR, marketed by Messrs. Keithley Instruments, USA. The photoconductor layer is characterized by the voltage of the charge ($U_o$) and by the time ($T_{1/2}$) after which the charge has been reduced to half its original value ($U_o/2$). The product of $T_{1/2}$ and the measured light intensity I (μW/cm$^2$) is the half-value energy $E_{1/2}$(μJ/cm$^2$).

The photosensitivity of the three double layers, measured by this method of characterization, is as follows:

| Material containing Cellulose Derivative | (−) $U_o$ | $E_{\frac{1}{2}}$ | $U_R$ (after 0.1 second) |
|---|---|---|---|
| a | 750 | 11.8 | 400 |
| b | 720 | 5.9 | 260 |
| c | 1075 | 3.1 | 210 |

The residual charge in volts ($U_R$) after 0.1 second, determined from the light decay curves above, is a further criterion for the discharge.

EXAMPLE 2

Under the conditions described in Example 1, dyestuff layers are applied to aluminum-vaporized polyester films and then layers containing different cellulose acetobutyrates mixed at a ratio, by weight, of 1:1 with 2,5-bis-(4'-diethylaminophenyl)-oxadiazole-1,3,4, are coated onto the dyestuff layers.

The conditions of preparation and measurement correspond to those of Example 1; the layer thickness of the applied top coatings is approximately 7 μm:

| Cellulose acetobutyrate | Viscosity, in poises | Butyryl Content (%) | Acetyl Content (%) | $-U_o$ | $E_{\frac{1}{2}}$ |
|---|---|---|---|---|---|
| a | 15–22.5 | 49 | 5 | 600 | 2.5 |
| b | 64–105 | 37 | 13.5 | 575 | 2.6 |
| c | 56–131 | 26 | 20.5 | 590 | 3.1 |
| d | 81–115 | 17 | 29.5 | 625 | 4.8 |

EXAMPLE 3

The flexibility of photoconductor layers containing cellulose acyl esters, such as cellulose acetobutyrates, of different viscosities is investigated. A charge carrier-producing dyestuff layer is applied as in Example 1 to polyester films of different thicknesses which had been made electrically conductive by aluminum-vaporization.

The dyestuff layer thus produced is then coated with a charge transport layer consisting of equal parts by weight of 2,5-bis-(4'-diethylaminophenyl)-oxadiazole-1,3,4, and one of the cellulose acetobutyrates mentioned below, in a tetrahydrofuran solution. The resulting layers have layer weights between about 7 and 9 g/m$^2$.

These recording materials are then formed into loops and subjected to a bending stress test. For this purpose, the loop of flexible photoconductor material is driven at a constant speed of rotation by a rubber roller of about 80 mm diameter and passed over rollers of different diameters, viz. 12, 18, and 25 mm. A standard test comprises 5,000 revolutions of the loop. with decreasing diameter of the rollers and increasing thickness of the support, the bending stress exerted upon the recording material increases so that the number of hairline cracks appearing on the surface of the photoconductor layer may increase under this stress. Advantageously, the formation of these hairline cracks is observed in the dark, with the aid of slanting light.

| Cellulose Acetobutyrate Layer | Thickness of Support, (μm) | Viscosity Range, (poises) | Diameter of Rollers, (mm) 18 | 12 |
|---|---|---|---|---|
| 1$^x$ | 75 | 3.8–7.6 | very few hairline cracks | |
| 2$^{xx}$ | 75 | 64–105 | no hairline cracks | |
| 2$^{xx}$ | 125 | 64–105 | no hairline cracks | |
| 2$^{xx}$ | 190 | 64–105 | no hairline cracks | |
| 2$^{xx}$ | 190 | 64–105 | | occasional hairline cracks |

$^x$cellulose acetobutyrate according to Example 2b, but with the particular viscosity stated above,
$^{xx}$cellulose acetobutyrate according to Example 2b.

It was found that the recording materials according to the invention show no hairline cracks or only very few hairline cracks under the considerable stress exerted by rollers of only 18 or even 12 mm diameter.

In contradistinction thereto, it was found that the thickness of the support and the diameter of the roller cause a distinct differentiation in photoconductor layers containing polyester resins or vinyl chloride/vinyl acetate copolymers.

A composition for a charge transport layer is prepared from 50 parts by weight of photoconductor, 25 parts by weight of polyester resin, and 25 parts by weight of a vinyl chloride/vinyl acetate copolymer analogously to the method described in the present examples and is applied, as a layer weighing 9 to 10 g/m$^2$, to a dyestuff layer as described in Example 1 and subjected to the bending stress test. It was found that, at a roller diameter of 25 mm and 5,000 revolutions, no hairline cracks appear in the photoconductive layer applied to a 75 μm thick polyester film; that occasional short hairline cracks form in the layer applied to a 125 μm thick polyester film; and that very strong, long hairline cracks appear in the layer applied to a 190 μm thick polyester film. Moreover, it was found that at a roller diameter of 18 mm, occasional hairline cracks appeared at a thickness of the support of 75 μm.

EXAMPLE 4

The pigment dyestuff used in Example 1 is suspended in a quantity of 5 percent (calculated on the solids content) in an 8 percent by weight tetrahydrofuran solution containing equal parts by weight of 2,5-bis-(4'-diethylaminophenyl)-oxadiazole-1,3,4,and a cellulose acetobutyrate with an acetyl content of 13.5 percent.

The composition was first adjusted to a concentration of 25 percent by weight and the pigment dyestuff in the highly viscous solution was then thoroughly ground for two hours in a Perl Mill PM 1 mixer (Draiswerke, Mannheim, Germany). The solution was then re-diluted to the above concentration. The resulting pigment dispersion is then applied, as a homogeneous layer of about 5 μm thickness, to an aluminum foil of 100 μm thickness, in accordance with the arrangement shown in FIG. 1.

The photosensitivity of the resulting material is measured under the conditions stated in Example 1 (light intensity about 100 μW/cm$^2$, xenon lamp type XBO 150): negative charge=390 V, $E_{1/2}$=16.5 μJ/cm$^2$.

EXAMPLE 5

A composition containing equal parts by weight of a cellulose acetobutyrate with an acetyl content of 13.5 percent and of a condensation product obtained by the reaction of perylene-3,4,9,10-tetracarboxylic acid anhydride and o-phenylene diamine in tetrahydrofuran is thoroughly ground for 2 hours in a Perl Mill PM 1 mixer. The highly viscous solution thus obtained is then diluted to 4 times its original quantity and the resulting coating solution is homogeneously applied to a 75 μm thick aluminum-vaporized polyester film. After drying, the pigment coating has a layer weight of 530 mg/m$^2$. This pigment layer is then coated with a uniform charge transport layer comprising equal parts by weight of 2,5-bis-(4'-diethylaminophenyl)-oxadiazole-1,3,4, and a cellulose acetobutyrate with an acetyl content of 5 percent (layer thickness about 7 μm, arrangement as in FIG. 4).

The photosensitivity is measured analogously to Example 1 (light intensity 90 μW/cm$^2$, xenon lamp type XBO 150). At a negative charge of 330 V, $E_{1/2}$=8.7 μJ/cm$^2$.

EXAMPLE 6

A condensation product of 3-bromopyrene and formaldehyde prepared according to German Offenlegungsschrift No. 2,137,288, is used as a polymeric charge transporting substance.

A perinone drystuff layer (Color Index No. 71,105) according to German Offenlegungsschrift No. 2,239,923, is vapor-deposited as described in Example 1 onto an aluminum-vaporized polyester film of 75 μm thickness so that the resulting layer weighs 90 mg/m$^2$, and the dyestuff layer is then coated with a tetrahydrofuran solution containing 70 parts by weight of the condensation product and 30 parts by weight of a cellulose acetobutyrate containing 5 percent of acetyl groups and having a viscosity of 20 poises. After drying, the resulting layer has a thickness of about 5 μm.

A measurement of the photosensitivity (light intensity 90 μW/cm$^2$, xenon lamp type XBO 150) yields a value of $E_{1/2}$=7.3 μJ/cm$^2$, at a negative charge of the layer of 410 volts.

If the dyestuff according to Example 1 is used and the material is given a negative charge of 630 volts, $E_{1/2}$ is 4.9 μJ/cm$^2$. If a polynuclear quinone is used as the dyestuff (Hostaperm Scarlet GO, C.I. 59,300) and the cellulose acetobutyrate has a viscosity of about 75 poises and an acetyl group content of 13.5 percent, a photosensitivity of $E_{1/2}$=4.7 μJ/cm$^2$ is measured at a negative charge of 430 volts.

EXAMPLE 7

A solution containing 50 parts by weight of 2,5-bis-(4'-diethylaminophenyl)-oxadiazole-1,3,4, 40 parts by weight of a cellulose acetobutyrate with an acetyl group content of 13.5 percent and a viscosity of about 75 poises, and 10 parts by weight of a cellulose acetate with an acetyl group content of about 40 percent and a viscosity of 40 poises is applied to a dyestuff layer corresponding to that used in Example 1 and dried to yield a layer of 8 to 9 μm thickness.

At a light intensity of 85 μW/cm$^2$ and a negative charge of the material of 800 volts, a photosensitivity of $E_{1/2}$=2.9 μJ/cm$^2$ was determined.

It will be obvious to those skilled in the art that many modifications may be made within the scope of the present invention without departing from the spirit thereof, and the invention includes all such modifications.

What is claimed is:

1. In an electrophotographic recording material comprising an electrically conductive support, optionally an insulating intermediate layer, and a photoconductive layer composed of at least one layer comprising charge carrier-producing and charge transporting compounds, a binder, and conventional additives, the improvement that the recording material comprises a 75 to 250 μm thick support and, in the form of a photoconductor web, is sufficiently flexible that it is not prone to the formation of hairline cracks when repeatedly conducted over rollers of at least 18 mm diameter, said binder being a cellulose acyl ester with an acetyl content of not more than 30 percent and a viscosity of more than 15 poises, measured by the ASTM methods D 817-65, Formula A, and D 1343-56, the ratio between cellulose acyl ester and the charge transporting compound being within the range of about 20 to 60 parts by weight to 80 to 40 parts by weight.

2. A recording material according to claim 1 in which the cellulose acyl ester has an acetyl content of not more than 15 percent and a viscosity of more than 15 poises.

3. A recording material according to claim 1 in which the cellulose acyl ester has an acetyl content of not more than 15 percent and a viscosity of more than 50 poises.

4. A recording material according to claim 1 in which the cellulose acyl ester contains acyl groups with 2 to 4 carbon atoms.

5. A recording material according to claim 1 in which the cellulose acyl ester is a cellulose acetobutyrate with a butyryl content of at least 15 percent.

6. A recording material according to claim 5 in which the cellulose acyl ester is a cellulose acetobutyrate with an acetyl content of not more than 15 percent and a viscosity in the range of 60 to 110 poises.

7. A recording material according to claim 1 comprising a sequence of layers of a 75 to 250 μm thick electrically conductive support of an aluminum-vaporized polyester film, a charge carrier-producing layer of 0.005 to 2 μm thickness, and a 2 to 20 μm thick charge transport layer composed of about 40 to 60 parts by weight of a monomeric organic charge transporting substance and 60 to 40 parts by weight of a cellulose acyl ester.

8. A recording material according to claim 2 in which the charge-producing layer contains a cellulose acyl ester.

9. A recording material according to claim 1 in which the photoconductive layer contains at least one monomeric or polymeric aromatic or heterocyclic compound as the charge transporting compound.

10. A recording material according to claim 9 in which the photoconductive layer contains a monomeric heterocyclic compound which is substituted by at least one dialkyl amino group.

11. A recording material according to claim 9 in which the monomeric heterocyclic compound is an oxadiazole.

12. A recording material according to claim 11 in which the heterocyclic compound is 2,5-bis-(4'-dialkylaminophenyl)-oxadiazole-1,3,4.

13. A recording material according to claim 9 in which the photoconductive layer contains a relatively highly condensed aromatic compound.

14. A recording material according to claim 13 in which the relatively highly condensed compound is a condensation product of formaldehyde and 3-bromopyrene.

* * * * *